US007476126B1

(12) United States Patent
Carden

(10) Patent No.: US 7,476,126 B1
(45) Date of Patent: Jan. 13, 2009

(54) CLIP-BASED FASTENING ARRANGEMENT FOR ATTACHING MULTI-PIN CONNECTOR TO REAR PANEL OF ELECTRONIC EQUIPMENT CHASSIS

(75) Inventor: Scott L. Carden, Huntsville, AL (US)

(73) Assignee: Adtran, Inc., Huntsville, AL (US)

( * ) Notice: Subject to any disclaimer, the term of this patent is extended or adjusted under 35 U.S.C. 154(b) by 0 days.

(21) Appl. No.: 11/534,699

(22) Filed: Sep. 25, 2006

(51) Int. Cl.
*H01R 13/73* (2006.01)

(52) U.S. Cl. ..... 439/573; 439/545

(58) Field of Classification Search ..... 439/544, 439/545, 552–557, 562–565, 567, 561, 573
See application file for complete search history.

(56) References Cited

U.S. PATENT DOCUMENTS 6,017,233 A * 1/2000 Fry et al. ..... 439/248
6,042,419 A * 3/2000 Liu ..... 439/557
6,168,453 B1 1/2001 Kuo ..... 439/357
6,210,216 B1 * 4/2001 Tso-Chin et al. ..... 439/545
6,736,566 B1 5/2004 Piehl et al. ..... 403/329
2002/0054786 A1 5/2002 Piehl et al. ..... 403/329

* cited by examiner

*Primary Examiner*—Ross N Gushi
(74) *Attorney, Agent, or Firm*—Allen, Dyer, Doppelt, Milbrath & Gilchrist, P.A.

(57) ABSTRACT

A clip is attachable to a flange of a connector terminating an electrical cable, and is configured to mechanically couple one side of the flange to an edge of a connector-installation aperture of a chassis, such that a distal end of the connector may engage a receptacle within the chassis. When the connector, with the clip attached, is placed in the chassis' connector-installation aperture, a notch region of the clip engages the chassis at an edge of its connector-installation aperture, causing a bore on a second side of the flange to be coaxial with a bore in the chassis, so that a hardware fitting therethrough may secure the connector to the chassis.

10 Claims, 3 Drawing Sheets

CLIP-BASED FASTENING ARRANGEMENT FOR ATTACHING MULTI-PIN CONNECTOR TO REAR PANEL OF ELECTRONIC EQUIPMENT CHASSIS

FIELD OF THE INVENTION

The present invention relates in general to electronics (e.g., telecommunications) equipment and components thereof, and is particularly directed to a clip-based fastening arrangement for facilitating aligned 'blind' insertion and attachment of a multi-pin communication cable connector, such as, but not limited to a 'telco'-type multi-pin connector, into a connector-installation aperture of a (rear) panel of an equipment chassis, so that the pins of the connector may readily electrically and mechanically engage corresponding sockets of an associated multi-socket receptacle of a printed circuit board installed in a card slot adjacent to the rear panel of the chassis.

BACKGROUND OF THE INVENTION

A variety of electronics systems, such as telecommunication systems, commonly employ multi-conductor cables to provide electrical connections to system components, such as, but not limited, to circuit components mounted on printed circuit cards installed within respective card slots of an electronics equipment bay. As shown in the diagrammatic side view of FIG. 1, the respective conductors of such a multi-conductor cable 10 are customarily terminated at pins of a multi-pin connector, such as a 'telco'-type multi-pin connector, shown generally at 20, and in detail in the respective front, side, front perspective and rear perspective views of FIGS. 2, 3, 4 and 5, respectively. This type of multi-pin connector is configured to (mechanically and electrically) mate with an associated multi-socket receptacle 30, such as may be mounted adjacent to a rear edge 42 of a printed circuit card 40, installed in a respective equipment chassis card slot.

Stable mechanical support for the multi-pin connector 20 is typically provided by way of a rear panel 50, upper and lower portions of which are affixed to (generally horizontally extending) frame members 60 of the equipment rack proper. The rear panel 50 may have one or more connector-receiving apertures 51. Such an aperture is sized to allow passage therethrough of a distal end 21 of multi-pin connector 20, so that the connector's pins may engage corresponding sockets in the distal end 31 of multi-socket receptacle 30. Where the rear panel contains a plurality of multi-pin connector-receiving apertures, the apertures are normally positioned so as to be alignable with corresponding multi-socket receptacles supported on multiple printed circuit cards, such as a pair of printed circuit cards installed in adjacent card slots, or a motherboard and an adjacent daughterboard mounted thereon by way of associated stand-offs.

In order to enable the multi-pin connector 20 to be stably retained by the rear panel 50, the rear panel customarily includes a pair of bores 52 and 53 adjacent to opposite (e.g., upper and lower) edges of the connector-receiving aperture 51. These bores are sized to receive hardware fittings, e.g., screws, that pass through associated bores 22 and 23 in a flange portion 24 of the multi-pin connector 20 on either side of its distal end 21, and affix the connector 20 to the rear panel 50.

A shortcoming of this type of connector attachment architecture is the fact that the connector's cable attachment interface 25 that joins the cable 10 with the connector proper overlaps and projects beyond the (lower) connector bore 23. This is particularly problematic as cable and circuit densities have increased, making access to attachment fittings difficult and cumbersome. As a consequence, in order to attach a fitting to each of the connector bore 23 and its associated rear panel bore 53, it is often necessary to remove the rear panel from the equipment chassis, so that the fitting can be inserted from the interior or card side of the rear panel through the bore 53 and into the bore 23 of the connector 20. Then, once the connector 20 has been attached to the rear panel (by way of fittings through each bore pair), the rear panel itself is reaffixed to the equipment rack. Unfortunately, removing the rear panel in order to attach such a connector means that any other printed circuit card, to which another respective connector supported by that rear panel is connected, will necessarily be taken off-line, and thereby disrupt service to its associated telecommunication circuit.

Proposals to avoid removing the rear panel in order to provide attachment to the lower portion of the connector (where the bore 23 is located), have included the use of wire ties, lacing cords, loop-and-hook strap attachments, and the like. Drawbacks of these approaches include their inherent lack of structural rigidity, their inability to ensure blind alignment between the multi-pin connector and its associated multi-socket receptacle on the printed circuit card, and the fact that they are labor intensive, which increases the cost of manufacture.

SUMMARY OF THE INVENTION

In accordance with the present invention, these and other shortcomings of conventional arrangements for attaching a multi-pin connector of a multi-conductor cable, such as but not limited to a multi-conductor telecommunication cable, to an associated multi-socket receptacle on a printed circuit card are effectively obviated by attaching a relatively physically robust (solid, e.g., metallic (aluminum)), rear panel-attachment clip member, or clip, to the multi-pin connector. The attachment clip is configured to allow aligned, 'blind' insertion of a standard multi-pin connector, from which the multi-conductor cable extends, into the bottom of a connector-installation aperture of the rear panel.

To this end, the clip includes a notch, or trough-like, region, that allows the lower side of a standard multi-pin connector to be stably captured in the rear panel, simply by placing the notch of the clip onto the bottom edge of the connector installation aperture, thereby confining opposite sides of the rear panel adjacent to the bottom edge of the aperture within the notch. As a result, no hardware fitting attachment bore adjacent to the lower edge of the connector-installation aperture is required. Since a physical connection between the multi-pin connector and such a bore is unnecessary, removal of the rear panel from the equipment chassis (in order to insert a fitting into the lower side of the connector from the interior or card side of the rear panel) is avoided, so that a circuit card in a different card slot terminated by that rear panel will not be taken off-line.

Moreover, being made of a relatively rugged, solid material (e.g., aluminum), in contrast to relatively flimsy prior art attachment devices, such as wire ties, lacing cords, loop-and-hook strap attachments, and the like, referenced above, the connector attachment clip of the invention is structurally robust. As a consequence, when inserted onto the bottom edge of the connector installation aperture, the clip, and thereby the lower portion of the multi-pin connector to which the clip is attached, will be stably and firmly retained within the rear panel.

DETAILED DESCRIPTION

Figure 6:
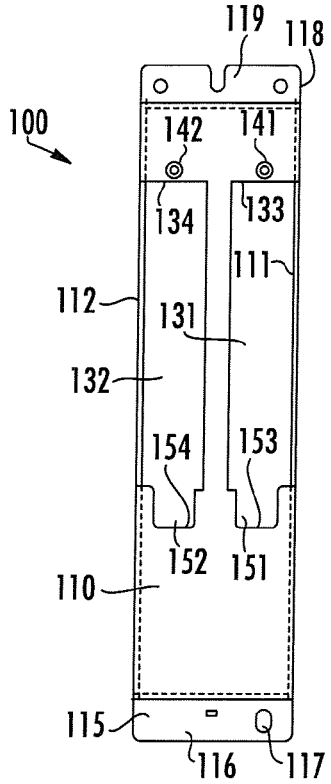
FIGS. 6, 7 and 8 are respective front, front perspective and rear perspective diagrammatic views of the configuration of a rear panel of the multi-pin connector attachment arrangement of the present invention.
Figure 7:
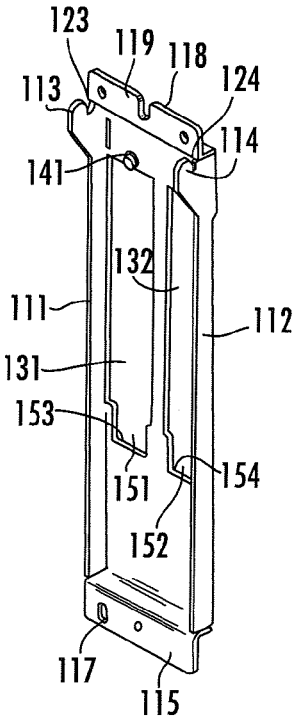
Figure 8:
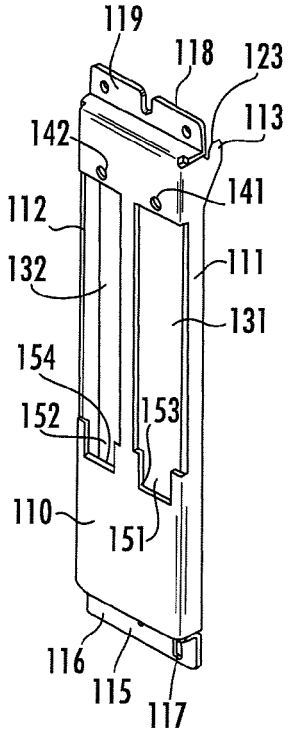
Figure 9:
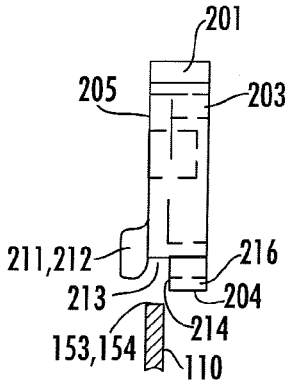
FIGS. 9, 10, 11 and 12 are respective side, rear, front perspective and rear perspective diagrammatic views of the configuration of a rear panel-attachment clip of the multi-pin connector attachment arrangement of the present invention.
Figure 10:
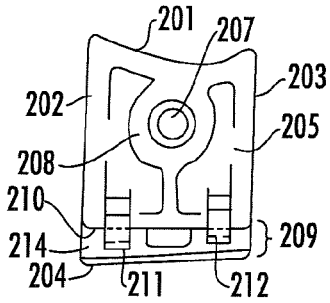
Figure 11:
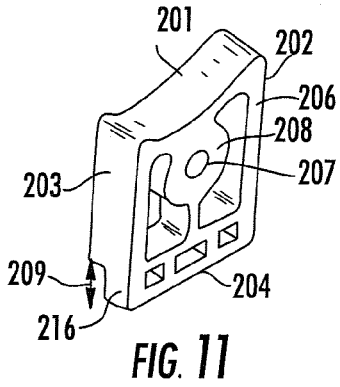
Figure 12:
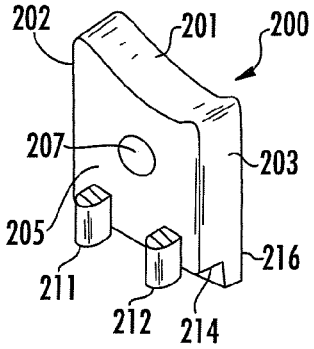

Attention is now directed to FIGS. 6, 7 and 8, which are respective front, front perspective and rear perspective diagrammatic views of the configuration of a rear panel employed in the multi-pin connector attachment arrangement of the present invention. As shown therein, the rear panel 100 includes a generally planar or flat, rectangular faceplate 110, from parallel side edges of which extend respective sidewalls 111 and 112. Upper ends of the sidewalls terminate at respective flange portions 113 and 114. Extending from a lower edge of the faceplate 110 is a generally L-shaped lower bend portion 115, having a lower lip portion 116 that is generally coplanar with the longitudinal edges of sidewalls 111 and 112 and includes a slot 117, that is sized to receive a fitting, such as a screw and the like, for attaching the lower bend portion 115 of the rear panel 100 to a corresponding bore in a generally horizontally extending frame member of a telecommunication equipment rack (such as the frame member 60 of FIG. 1).

In a like manner, extending from an upper edge of the faceplate 110 is a generally L-shaped upper bend portion 118, having an upper lip portion 119, that is also generally coplanar with the longitudinal edges of sidewalls 111 and 112. The upper lip portion 119 includes one or more slots or bores 120 (two being shown in the Figures), that are sized to receive fittings, such as screws and the like, for fixedly attaching the upper bend portion 118 of the rear panel 100 to corresponding bores in a generally horizontally extending frame member of a telecommunication equipment rack. The upper lip 119 of the rear panel cooperates with notches 123 and 124 in the respective flange portions 113 and 114 of the rear panels sidewalls 111 and 112, so that the rear panel may engage and capture therebetween a lower edge portion of a (generally horizontally extending) frame member of the equipment rack, and thereby be rigidly secured thereto. For this purpose, upper distal ends 125 and 126 of the respective flange portions 113 and 114 of the rear panels sidewalls 111 and 112 of the rear panel preferably have generally curvilinear surfaces, as shown, so as to facilitate pivotal engagement of the rear panel with (and disengagement from) a lower edge portion of equipment rack frame member.

For the non-limiting application of providing a protective closure and cable attachment location for a pair of printed circuit cards installed in mutually adjacent card slots of an equipment rack, the front panel's faceplate 110 is shown as being provided with a pair of parallel, generally rectangularly shaped, multi-pin connector-installation apertures 131 and 132. Each connector-installation aperture 131, 132 is sized to accommodate the insertion therein of the distal end of a multi-pin connector of the type shown in FIGS. 2-5, so that the connector's pins may engage corresponding sockets in the distal end of a multi-socket receptacle mounted on a printed circuit card installed in a respective one of the two mutually adjacent card slots that are closed by the rear panel 100. Namely, for the illustrated example of a rear panel faceplate 110 having two connector-installation apertures 131 and 132, these apertures are spaced apart from one another by a distance that provides alignment between multi-pin connectors retained therein with corresponding multi-socket receptacles of a pair of printed circuit cards installed in mutually adjacent card slots of the equipment rack.

Figure 1:
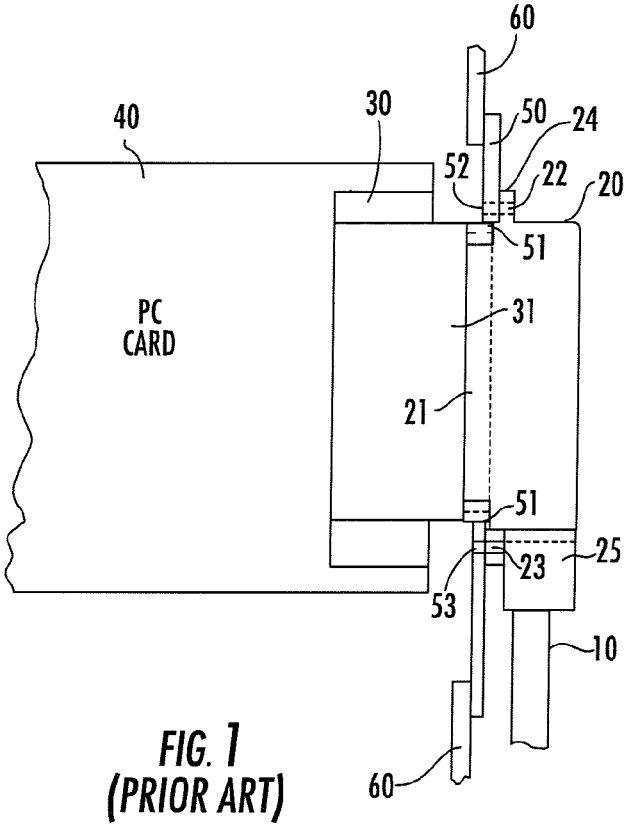
FIG. 1 (PRIOR ART)
FIG. 1 is a diagrammatic side view of the manner of attachment of a multi-pin connector of a multi-conductor telecommunication cable with a multi-socket receptacle mounted on a printed circuit card installed in a card slot of a telecommunication equipment bay.
Figure 2:
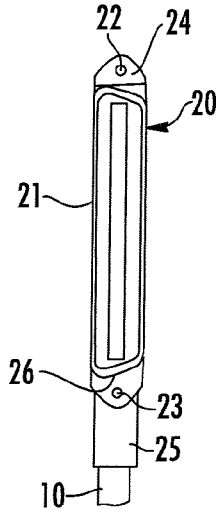
FIG. 2 (PRIOR ART)
FIGS. 2, 3, 4 and 5 are respective diagrammatic front, side, front perspective and rear perspective views of a standard multi-pin telco-type connector.
Figure 3:
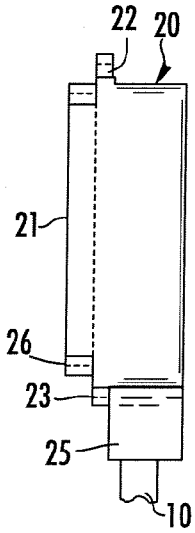
FIG. 3 (PRIOR ART)
Figure 4:
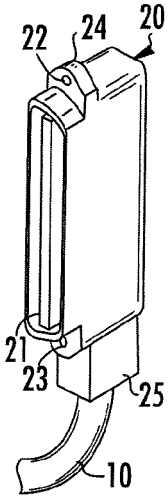
FIG. 4 (PRIOR ART)
Figure 5:
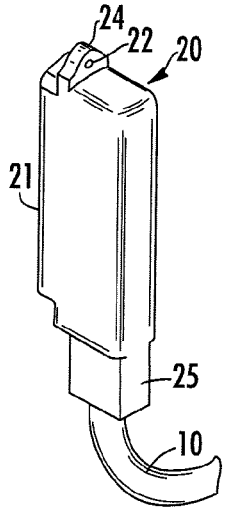
FIG. 5 (PRIOR ART)

Similar to the conventional rear panel 50 shown in FIG. 1, the rear panel 100 of FIGS. 6, 7 and 8 includes upper (threaded) bores 141 and 142 adjacent to upper edges 133 and 134 of the connector-receiving apertures 131 and 132. As in conventional rear panel, these apertures are sized and located to receive hardware fittings, e.g., screws, that pass through associated upper bores 22 in a standard multi-pin connector, such as that shown in FIGS. 2-5, when a multi-pin connector is inserted into a respective aperture 131, 132. However, unlike the conventional rear panel, there are no similar lower bores adjacent lower edges of the apertures for receiving hardware fittings that pass through the lower bores 23 in the multi-pin connector, when that connector is inserted into a respective aperture 131, 132.

Instead, the depths of the lower portions of the connector-installation apertures 131 and 132 are increased or extended by means of respective, generally rectangular, connector installation-aperture extension slots 151 and 152, that terminate at respective lower edges 153 and 154 thereof. Each of these aperture extension slots is sized and shaped to accommodate the insertion therein of a respective rear panel-attachment clip, illustrated diagrammatically in FIGS. 9, 10, 11 and 12. Preferably, the width of each aperture extension slot is slightly wider than the width of a clip, so as to allow for a slight amount of (horizontal) play between the clip and the slot, and thereby accommodate minor offsets in the position of the printed circuit card installed in the card slot that is terminated by the rear panel, and facilitate 'blind' engagement of the pins of the multi-pin connector with the sockets of the multi-socket receptacle mounted on the printed circuit card.

As shown in FIGS. 9-12, a respective rear panel-attachment clip 200 is configured as a generally rectangularly shaped, solid element, made of a relative rugged, robust material such as aluminum, having an upper wall 201, which has a slightly inclined surface that generally conforms with the inclined shape of the lower edge 26 of the distal end 21 of the multi-pin connector shown in FIGS. 2-5. This inclination of the surface of upper wall 201 serves as a physical 'key', to ensure that the clip 200 will be properly oriented with its rear surface abutting against the multi-pin connector and its tab end down for engagement with a lower edge 153, 154 of a respective aperture extension slot 151, 152, when the clip 200 is installed on the connector 20, as will be described.

Other than the slightly inclined shape of its upper wall 201, the remainder of the generally solid, rear panel-attachment clip is generally rectangularly shaped, having a pair of parallel sidewalls 202 and 203, that extend from upper wall 201 and adjoin a bottom wall 204. Each of the upper wall 201, sidewalls 202 and 203, and bottom wall 204 extends between a generally planar rear surface 205, that is directly abutable against the multi-pin connector, and a generally planar front surface 206, that faces the interior of the card slot when the connector, with the clip attached, is inserted into a connector-installation aperture. A hardware fitting bore 207 is formed in the clip's rear surface 205 and passes through a boss region 208 that extends between and is solid with the upper wall 201 and the lower wall 204. The clip 200 is attached to the multi-pin connector 20 by means of a hardware fitting, such as a screw, inserted through bore 207 in boss regions 208 of clip 200 and into bore 23 of the connector.

The height of the rear surface 205 of the clip is slightly less than the height of its front surface 206, so as to provide a vertical offset 209 between a lower, generally rectilinear edge 210 of the rear surface 205, which conforms with the generally rectilinear bottom edge 153, 154 of a respective connector installation-aperture extension slot 151, 152 of rear panel 100, and the bottom wall 204 of the clip. This offset allows one or more tabs, such as the two tabs shown at 211 and 212, that are solid with the lower portion of the rear surface 205 of the clip, to define a rear panel capture region or notch 213 to be formed between the tabs 211 and 212 and a front face 214 of a lower portion 216 the clip adjacent to its bottom wall 204. (The generally rectangular holes in the lower position 216 of the clip serve to reduce material only and are otherwise non-directional.) The width of the notch 213 generally corresponds to, but is just slightly wider than, the thickness of the rear panel's faceplate 110. As a result, as shown in the side view of FIG. 9 a lower edge 153, 154 of the rear panel faceplate 110 at the bottom of an aperture extension slot 151, 152 is allowed to enter and be captured by the notch 213, and thereby stably secure the clip 200, and thereby the lower portion of the multi-pin connector to which the clip has been attached, to the rear panel.

To this end, the distance between the bore 207 in the boss region 208 and the lower edge 210 of the rear surface 205 of the clip is such that, when the clip 200 is attached to the connector, by means of a hardware fitting passing through the bore 207 in the clip that is coaxial with the bore 23 in the connector, the lower edge 210 of the rear surface 205 of the clip 200 will rest upon or be very slightly vertically offset from a bottom edge 153, 154 of an aperture extension slot 151, 152. In addition, this distance is such that the upper bore 22 of the connector will be aligned with an upper one of the bores 141 and 142 of the rear panel faceplate 110, so that the connector 20 may be readily affixed to the faceplate 110 by means of a hardware fitting that passes through the upper bore 22 in the connector 20 and its associated aligned bore (one of bores 141 and 142) in the faceplate 110.

Figure 13:
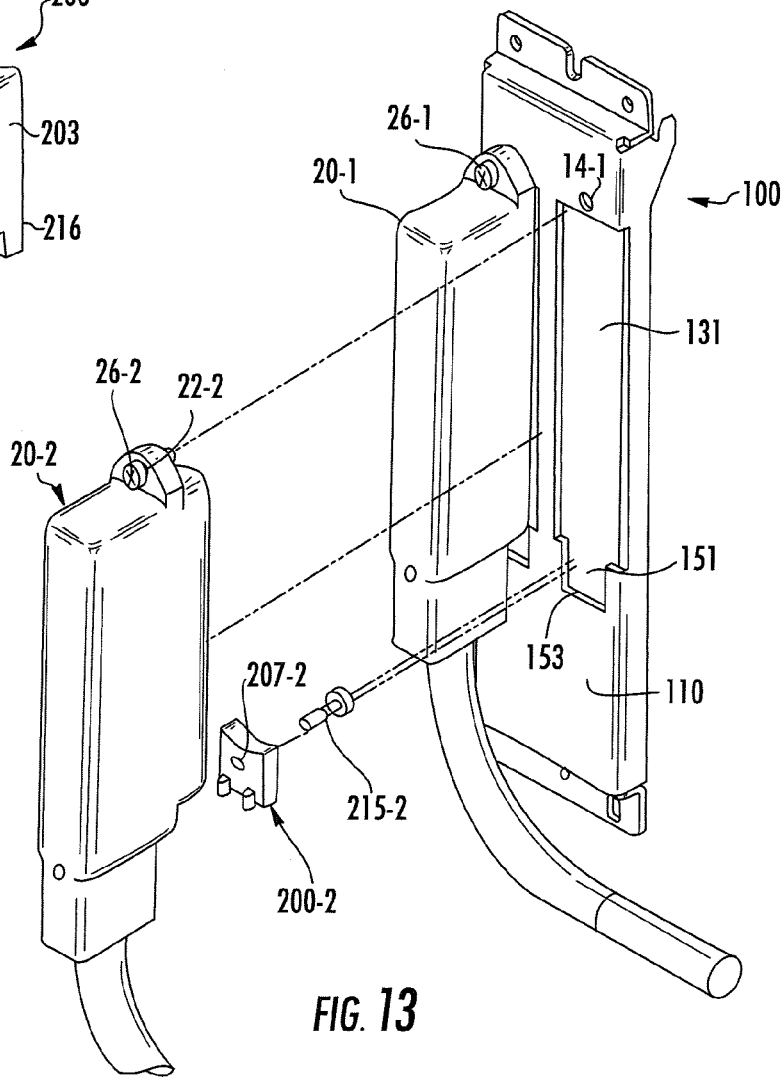
FIG. 13 is a partially exploded, diagrammatic perspective view of the manner of attachment of a pair of multi-pin connectors and associated rear panel-attachment clips of the invention to respective connector-installation apertures of a rear panel of a telecommunication equipment chassis.

This connectivity alignment relationship, that is provided by the configurations and geometries of the panel-attachment clip 200 and a respective aperture extension slot in the rear panel faceplate, is diagrammatically illustrated in the perspective, partially exploded view of FIG. 13. In particular, FIG. 13 shows a pair of multi-pin connectors 20-1 and 20-2, which have respectively associated rear panel-attachment clips 200-1 and 200-2. Connector 20-1 and its associated rear panel-attachment clip 200-1 attached thereto are shown in their installed positions in the connector-installation aperture 132 of the rear panel 100; connector 20-2, its associated clip 200-2, and a hardware fitting (screw) 215-2 that joins the clip 200-2 to the connector 20-2 are shown in spaced apart, but aligned relationship with respect to each other and with respect to the connector-installation aperture 131 of rear panel 100.

As can be seen from FIG. 13, when a respective clip 200 is placed upon a multi-pin connector 20 in its proper orientation (namely, 'keyed' by the inclination of the surface of its upper wall 201, as described above), and attached to that connector by means of a fitting (e.g., screw) that passes through the clip's bore 207 into an associated lower connector bore (corresponding to the connector bore 23, described above, but not shown in FIG. 13), the lower edge 210 of the rear surface 205 of the clip may be readily placed directly upon, or just slightly vertically offset from, the bottom edge 153, 154 of the faceplate's aperture extension slot 151, 152. In this aperture-inserted position of the clip, the lower edge 153, 154 of the rear panel faceplate 110 at the bottom of a respective aperture extension slot 151, 152 is captured within the clip's notch 213 formed between the tabs 211 and 212 and the front face 214 of the lower portion the clip adjacent to its bottom wall 204, so as to stably secure the clip 200, and thereby the lower portion of the multi-pin connector to which the clip has been attached, to the rear panel.

With the notch 213 at the bottom of the clip 200 captured at the bottom edge 153, 154 of the connector installation aperture-extension slot 151, 152, the upper bore 22 of the connector 20 will be aligned with an upper bore 141/142 of the faceplate 110, allowing the pins of the multi-pin connector 20 to be inserted into and engage the sockets of a multi-socket receptacle at the rear of the printed circuit card. The connector 20 may now be securely attached to the rear panel by means of a hardware fitting (e.g. screw), that passes through the upper bore 22 and its associated aligned bore 141/142 in the rear panel faceplate 110. Removal of the multi-pin connector from the rear panel is straightforward, requiring only a disengagement of the hardware fitting in the upper bore 22 of the connector from the upper bore 141/142 of the faceplate, followed by lifting the connector and its attached clip off the bottom edge of the extension slot.

As pointed out previously, and as will be appreciated from the foregoing description, the rear panel-attachment clip of the invention allows the lower side of a standard multi-pin connector, from which the multi-conductor cable extends, to be readily and stably captured in the rear panel, simply by placing the notch of the clip into engagement with the bottom edge of the connector installation aperture. As a result, the undesirable task of removing the rear panel from the equipment chassis (in order to insert a fitting into the lower side of the connector from the interior or card side of the rear panel) is avoided, so that a circuit card in a different card slot terminated by that rear panel will not be taken off-line. Moreover, because it is made of a relatively rugged, solid material, in contrast to relatively flimsy prior art attachment devices, such as wire ties, lacing cords, loop-and-hook strap attachments, and the like, the attachment clip of the invention is structurally robust, so that, when inserted onto the bottom edge of the connector installation aperture, the clip, and thereby the lower portion of the multi-pin connector to which the clip is attached, will stably engage the rear panel.

While I have shown and described a non-limiting, but preferred, embodiment of the invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed is:

1. A cable and panel assembly, comprising:

a. a mounting material comprising a panel for attachment to a frame and including at least one first protrusion for engaging a back side of the frame at least one point and at least one second protrusion to engage the front side of the frame;

b. at least one multi-pin connector;

c. a clip attached to said at least one multi-pin connector at one end to secure the at least one multi-pin connector to one end of a respective aperture in a mounting material to which the connector is affixed by engaging front and back sides of said mounting material; and d. an opening at an opposite end of said multi-pin connector to which attachment of the connector to the mounting material is established.

2. The cable and panel assembly of claim 1, in which the clip is configured to confine opposite sides of said material at said one end of an aperture.

3. The cable and panel assembly of claim 1, further comprising at least one cable having conductors connected to pins of a respective multi-pin connector.

4. The cable and panel assembly of claim 3, wherein the panel has a wall thickness through which a respective aperture is formed.

5. The cable and panel assembly of claim 1, in which the panel has at least one opening, cooperating with said first and second protrusions, to affix the panel to said frame.

6. The cable and panel assembly of claim 5, in which the opening is a slot.

7. The cable and panel assembly of claim 5, in which the frame connects to an assembly comprising one or more PC cards, the assembly having at least one connector which can mate to said multi-pin connector.

8. A method of attaching a multi-pin connector to a mounting material containing an aperture, comprising the steps of:

a. attaching a clip to one end of the multi-pin connector;

b. seating the attached clip at one end of the aperture to engage front and back sides of material forming one end of said aperture;

c. securing the other end of the multi-pin connector to said material; and wherein the mounting material comprises a panel for attachment to a frame and includes at least one protrusion for engaging a back side of the frame at least one point and at least one second protrusion to engage the front side of the frame.

9. The method of claim 8, in which the panel has at least one opening, cooperating with said first and second protrusions, to affix the panel to said frame.

10. The method of claim 9, in which the opening is a slot.

* * * * *